US009246227B2

(12) United States Patent
Cheng et al.

(10) Patent No.: US 9,246,227 B2
(45) Date of Patent: Jan. 26, 2016

(54) HORN ANTENNA DEVICE AND STEP-SHAPED SIGNAL FEED-IN APPARATUS THEREOF

(71) Applicant: FINETEK CO., LTD., New Taipei (TW)

(72) Inventors: Shu-Chien Cheng, New Taipei (TW); I-Chu Lin, New Taipei (TW); Yi-Yan Lee, New Taipei (TW); Tzu-Chuan Tsai, New Taipei (TW); Chao-Kai Cheng, New Taipei (TW)

(73) Assignee: FINETEK CO., LTD., New Taipei (TW)

( * ) Notice: Subject to any disclaimer, the term of this patent is extended or adjusted under 35 U.S.C. 154(b) by 110 days.

(21) Appl. No.: 13/952,643

(22) Filed: Jul. 28, 2013

(65) Prior Publication Data

US 2015/0029065 A1 Jan. 29, 2015

(51) Int. Cl.

| | |
|---|---|
| ***H01Q 13/02*** | (2006.01) |
| ***H01Q 19/06*** | (2006.01) |
| ***H01P 5/103*** | (2006.01) |

(52) U.S. Cl.

CPC ..... *H01Q 13/0208* (2013.01); *H01P 5/103* (2013.01); *H01Q 19/06* (2013.01)

(58) Field of Classification Search

CPC ..... H01Q 13/02; H01Q 13/0208; H01Q 13/0216; H01P 5/103; H01P 1/04; H01P 1/042; H01P 1/045

USPC ..... 343/772, 786; 342/124; 333/245, 248, 333/254, 255

See application file for complete search history.

(56) References Cited

U.S. PATENT DOCUMENTS

| | | | | |
|---|---|---|---|---|
| 3,737,812 | A * | 6/1973 | Gaudio et al. | 333/32 |
| 2003/0179148 | A1 * | 9/2003 | Ohlsson | 343/786 |
| 2006/0044207 | A1 * | 3/2006 | Dolson | 343/878 |
| 2009/0212996 | A1 * | 8/2009 | Chen et al. | 342/124 |
| 2010/0066594 | A1 * | 3/2010 | Kienzle et al. | 342/175 |
| 2012/0206312 | A1 * | 8/2012 | Coupland et al. | 343/786 |

* cited by examiner

*Primary Examiner* — Robert Karacsony
(74) *Attorney, Agent, or Firm* — Chun-Ming Shih; HDLS IPR Services

(57) ABSTRACT

The present invention relates to a horn antenna device. The horn antenna device has a step-shaped signal feed-in apparatus and a conical horn antenna. The step-shaped signal feed-in apparatus has a stepped body having multiple stairs and a connecting pin. The stepped body is adapted to radiate electromagnetic waves and receive a reflection of the electromagnetic waves. According to the structure of the step-shaped signal feed-in apparatus of the invention, the resonating modes are easy to be determined. The directivity and the signal-to-noise rate are improved. In addition, the connecting pin is directly connected to the stairs for improving the signal stability of the horn antenna device.

16 Claims, 9 Drawing Sheets

HORN ANTENNA DEVICE AND STEP-SHAPED SIGNAL FEED-IN APPARATUS THEREOF

BACKGROUND OF THE INVENTION

1. Field of the Invention

The present invention relates to an antenna device, and more particularly to a horn antenna device with a step-shaped signal feed-in apparatus for focusing electromagnetic waves.

2. Description of Related Art

In order to measure an object level, such as water level in a reservoir or mineral stockpiles of a quarry, a radar level meter is developed to measure the object level.

The radar level meter can be installed at a position far from an object. The radar level meter mainly comprises a circuit board and an antenna. The circuit board generates electromagnetic waves of FMCW (frequency modulated continuous waves) and radiates the electromagnetic waves toward the object through the antenna. The electromagnetic waves are then reflected from a surface of the object when the electromagnetic waves reach the object. Afterward, the circuit board can receive a reflection of the electromagnetic waves from the antenna.

The circuit board has a controller. The controller calculates a frequency difference and a time difference between the reflection and the electromagnetic waves emitted from the antenna. When the controller obtains the frequency difference and the time difference, the controller calculates a distance between the radar level meter and the surface of the object or further calculates an object level according to the distance.

With reference to FIG. 9, a conventional level measuring device is disclosed. The measuring device comprises a radar level meter 80 and a waveguide apparatus 90. The waveguide apparatus 90 has a body 91, a medium converter 92 and a feed-in connector 93. The body 91 has an opening 911, a hole 912 and a space 913. The space 913 communicates with the opening 911 and the hole 912. The medium converter 92 is conical in shape and has a cone point 921 and a bottom end 922 distal to the cone point 921. The bottom end 922 of the medium converter 92 is mounted in the opening 911 of the body 91. The feed-in connector 93 can be an SMA connector or an SMP connector and is inserted in the hole 912. The feed-in connector 93 has a probe 931 extending into the space 913 of the body 91.

The radar level meter 80 is connected to an end of the waveguide apparatus 90 distal to the probe 931. The radar level meter 80 feeds high frequency electromagnetic waves into the space 913 of the body 91 through the feed-in connector 93. The medium convertor 92 thus radiates the electromagnetic waves outward. The medium converter 92 is used for matching impedance. The medium converter 92 converts a spherical wave to a plane wave beneficial for transmitting and receiving wireless signals.

However, the electromagnetic waves generated from the feed-in connector 93 are fed in the medium converter 92 via the space 913. The electromagnetic waves are not directly fed in the medium converter 92. As such, the resonating modes, such as TE mode and TM mode, of the electromagnetic waves are difficult to be determined. Correspondingly, it is complicated and highly time-consuming to design the structures of the waveguide apparatus 90. Assembling problems, such as the feed-in connector 93 not exactly mounted in the hole 912 and the medium convertor 92 not securely mounted to the body 91, result in inadequate stability.

With reference of FIG. 10, a reflection coefficient (S11) chart of the electromagnetic waves generated from the waveguide apparatus 90 is disclosed. The return loss at 9.0 (GHz) is −12.5 (dB). The return loss at 9.5 (GHz) is −15.846 (dB). The return loss at 10 (GHz) is −13.285 (dB). When the return loss is lower than −10 (dB), a band width is only 1.75 (GHz), wherein 10.5 (GHz)−8.75 (GHz)=1.75 (GHz). A radiation pattern of the medium convertor 92 is easily affected and thus lowers the signal quality.

SUMMARY OF THE INVENTION

An objective of the invention is to provide a horn antenna device and a step-shaped signal feed-in apparatus thereof. The resonating modes of the horn antenna device of the invention can be easily determined and the horn antenna device can be correctly assembled with ease. The band width of the horn antenna device of the invention is extended.

The step-shaped signal feed-in apparatus comprises:

a fixture base having:

a first end;

a second end distal to the first end; and a connector formed in the first end;

a head connected to the connector of the fixture base and having a socket; and a stepped body mounted in the fixture base and having:

multiple stairs sequentially formed along an axial direction of the fixture base, wherein a highest stair is near the first end of the fixture base, and a lowest stair is near the second end of the fixture base; and a connecting pin formed on a side surface of the highest stair and connected to the socket of the head.

The horn antenna device comprises:

a step-shaped signal feed-in apparatus comprising:

a fixture base having:

a first end;

a second end distal to the first end; and a connector formed in the first end;

a head connected to the connector of the fixture base and having a socket; and a stepped body mounted in the fixture base and having:

multiple stairs sequentially formed along an axial direction of the fixture base, wherein a highest stair is near the first end of the fixture base, and a lowest stair is near the second end of the fixture base; and a connecting pin formed on a side surface of the highest stair and connected to the socket of the head; and a conical horn antenna having:

a signal input-and-output (I/O) end connected to the second end of the fixture base of the step-shaped signal feed-in apparatus; and a signal radiating end distal to the signal I/O end.

The resonating modes of the horn antenna device of the invention can be easily determined and designed according to dielectric of air and the step-shaped signal feed-in apparatus. The stairs are directly connected to the connecting pin, such that high frequency signals can be accurately sent from the connecting pin to the stairs. The stability of the horn antenna device is improved.

In addition, the directivity of the horn antenna device of the invention is improved. In a radiation pattern of the invention, a width of a main lobe becomes narrower and energy of side lobes is decreased, such that the signal-to-noise rate (SNR) is increased.

DETAILED DESCRIPTION OF THE PREFERRED EMBODIMENT

The horn antenna device of the invention comprises a step-shaped signal feed-in apparatus and a conical horn antenna, or further comprises a lens antenna.

Figure 1:
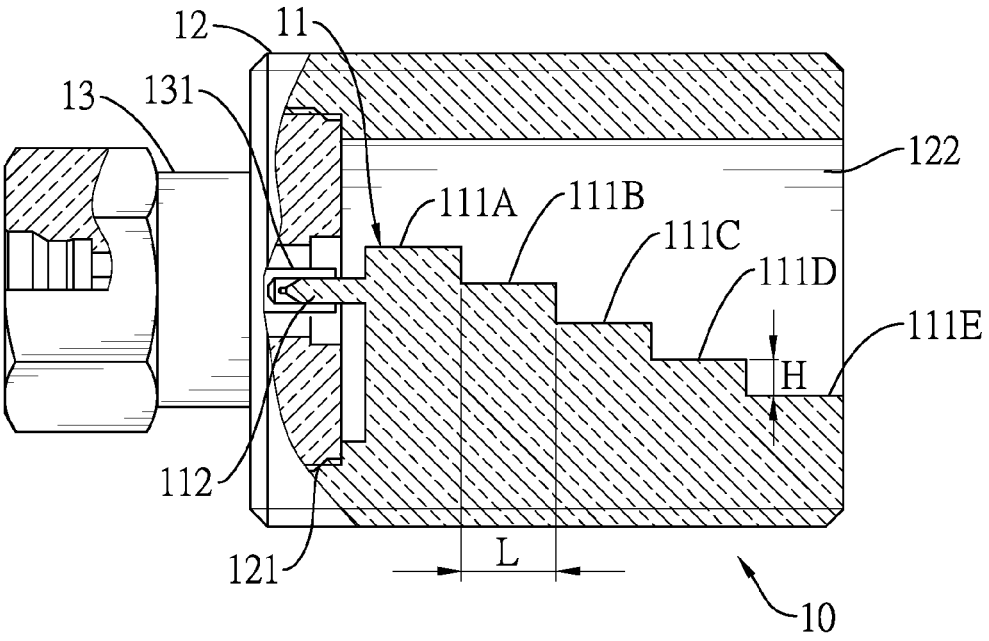
FIG. 1 is a partially cross-sectional view of a step-shaped signal feed-in apparatus of the invention.
Figure 2:
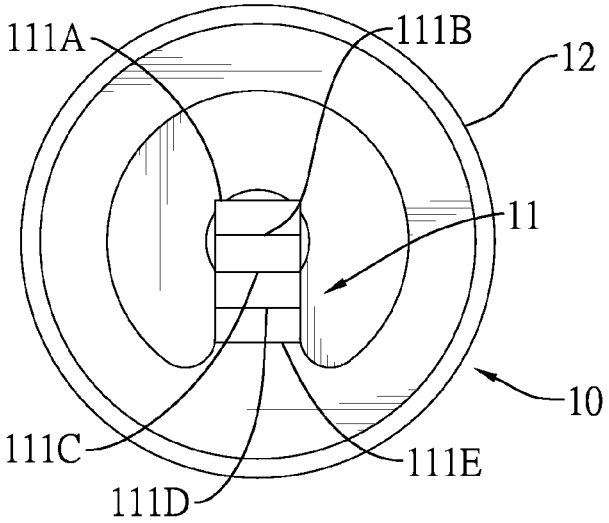
FIG. 2 is a plan view of the step-shaped signal feed-in apparatus in FIG. 1.

With reference to FIGS. 1 and 2, a first embodiment of the step-shaped signal feed-in apparatus of the invention is disclosed. The step-shaped signal feed-in apparatus 10 comprises a stepped body 11, a fixture base 12 and a head 13.

The fixture base 12 is a hollow cylinder and has a connector 121, a space 122, a first end and a second end distal to the first end. The connector 121 is formed in the first end of the fixture base 12.

The stepped body 11 is mounted in the fixture base 12 and has multiple stairs including a first stair 111A, a second stair 111B, a third stair 111C, a fourth stair 111D, a fifth stair 111E and a connecting pin 112. The stairs 111A-111E are sequentially formed along an axial direction of the fixture base 12. The first stair 111A is the highest stair and is near the first end of the fixture base 12. The fifth stair 111E is the lowest stair and is near the second end of the fixture base 12. With reference to FIG. 1, the length (L) of each stair 111A-111E is quarter of a wave length ($\lambda/4$) of an electromagnetic wave emitted from the stepped body 11 of the step-shaped signal feed-in apparatus 10. The height differences (H) between each two adjacent stairs 111A-111E are equal to each other. The connecting pin 112 is formed on a side surface of the first stair 111A, wherein an extending direction of the connecting pin 112 can be parallel to or be vertical to the axial direction of the fixture base 12. In this embodiment, the extending direction of the connecting pin 112 is parallel to the axial direction of the fixture base 12.

The head 13 has a connecting end and a socket 131. The connecting end is adapted to be connected to or be screwed in the connector 121 of the fixture base 12. The socket 131 is formed on the connecting end and is exposed in the space 112 of the fixture base 12, such that the connecting pin 112 of the stepped body 11 is inserted in the socket 131 to be electrically connected to the socket 131.

A high frequency signal is sent to the connecting pin 112 through the socket 131 of the head 13. Thus the high frequency signal is converted to electromagnetic waves radiating outward through the stairs 111A-111E. In addition, the step-shaped signal feed-in apparatus 10 can receive a reflection of the electromagnetic waves.

Figure 3:
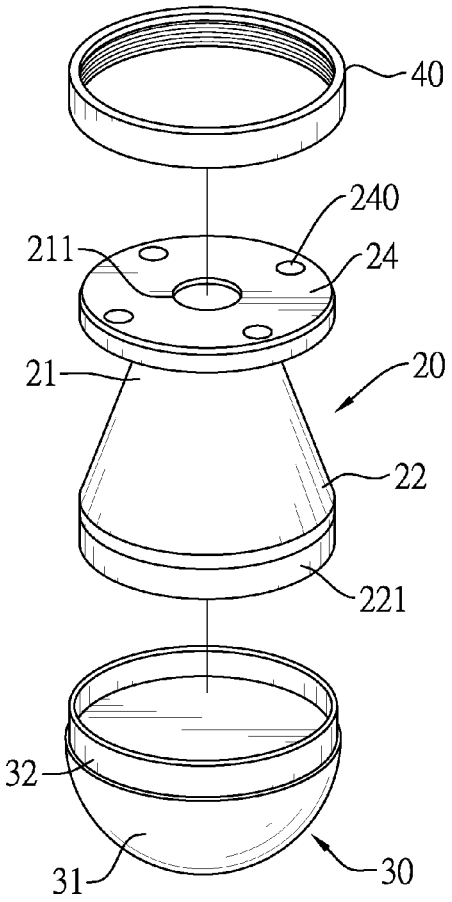
FIG. 3 is an exploded perspective view of a conical horn antenna and a lens antenna.
Figure 4B:
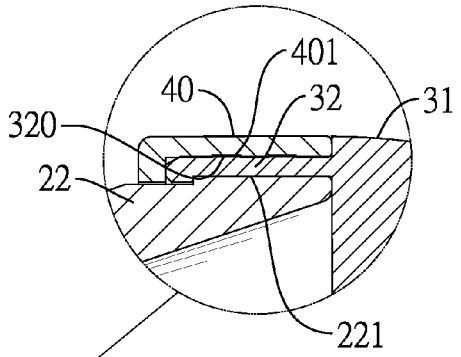
FIG. 4B is a partially enlarged view of FIG. 4A.
Figure 4A:
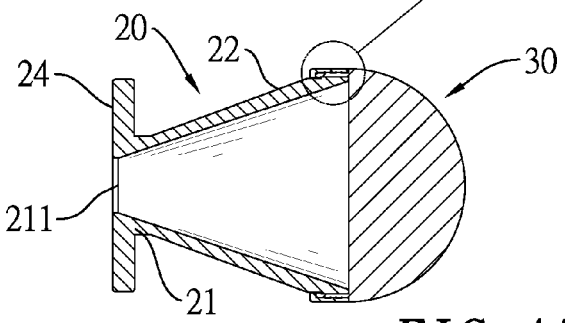
FIG. 4A is a cross-sectional view of the conical horn antenna and the lens antenna in FIG. 3.

With reference to FIGS. 3, 4A and 4B, the conical horn antenna 20 and the lens antenna 30 are disclosed. The conical horn antenna 20 is a hollow cone and has an opening 211, a first end and a second end. The first end of the conical horn antenna 20 is a signal I/O (input-and-output) end 21. The opening 211 is formed in the signal I/O end 21 and communicates with the space 122 of the fixture base 12 of step-shaped signal feed-in apparatus 10. In this embodiment, the conical horn antenna 20 has a panel 24 laterally extending on the signal I/O end 21, wherein the opening 211 can be formed in a middle of the panel 24. The panel 24 can be a circular panel, a rectangular pane, a hexagonal panel or any polygonal panel. The panel 24 can have multiple screw holes 240.

The second end of the conical horn antenna 20 is a signal radiating end 22 opposite the signal I/O end 21. The signal radiating end 22 is adapted to radiate electromagnetic waves or to receive the reflection of the electromagnetic waves. In this embodiment, the signal radiating end 22 has an engaging protrusion 221 for being engaged with the lens antenna 30.

The lens antenna 30 comprises a lens body 31 and a hook 32. The lens body 31 is a hemispherical body and has a plane surface. The hook 32 is formed on an edge of the plane surface to be engaged with the engaging protrusion 221.

In order to further closely connect the conical horn antenna 20 to the lens antenna 30, a ring 40 is adapted to be mounted on the hook 32. The hook 32 can have external threads 320. With reference to FIG. 4B, in a cross-sectional view, the ring 40 is L-shaped. The ring 40 has internal threads 401, such that the internal threads 401 of the ring 40 can be screwed with the external threads 320 of the hook 32. Since the hook 32 is screwed with the ring 40, the lens antenna 30 is closely connected to the conical horn antenna 20. Moisture or foreign object can hardly enter and affect the conical horn antenna 20.

The lens antenna 30 is usually operated under high pressure environment or thermal cycle environment. The conical horn antenna 20 and the lens antenna 30 are further securely engaged with each other by thermal expansion or cold contraction of the conical horn antenna 20 and the lens antenna 30, or by pressure exerted on the conical hone antenna 20 and the lens antenna 30. The conical horn antenna 20 can be tightly connected to the lens antenna 30.

The step-shaped signal feed-in apparatus 10 radiates the electromagnetic waves, or receives the reflection through the conical horn antenna 20 and the lens antenna 30. The conical horn antenna 20 and the lens antenna 30 can be, but are not limited to, made of material selected from a group consisting of metal, PVDF, polytetrafluoroethene, paraffin, polyethylene, polymethylmethacrylate, polystyrene, flint glass, polygas and rutile. The lens body 31 of the lens antenna 30 can be, but is not limited to, a convex lens, a concave lens, a Bi-convex lens, a Plano-Convex lens; a Positive meniscus lens, a Negative meniscus lens, a Plano-concave and Bi-concave lens or a combination of such lens.

Figure 5:
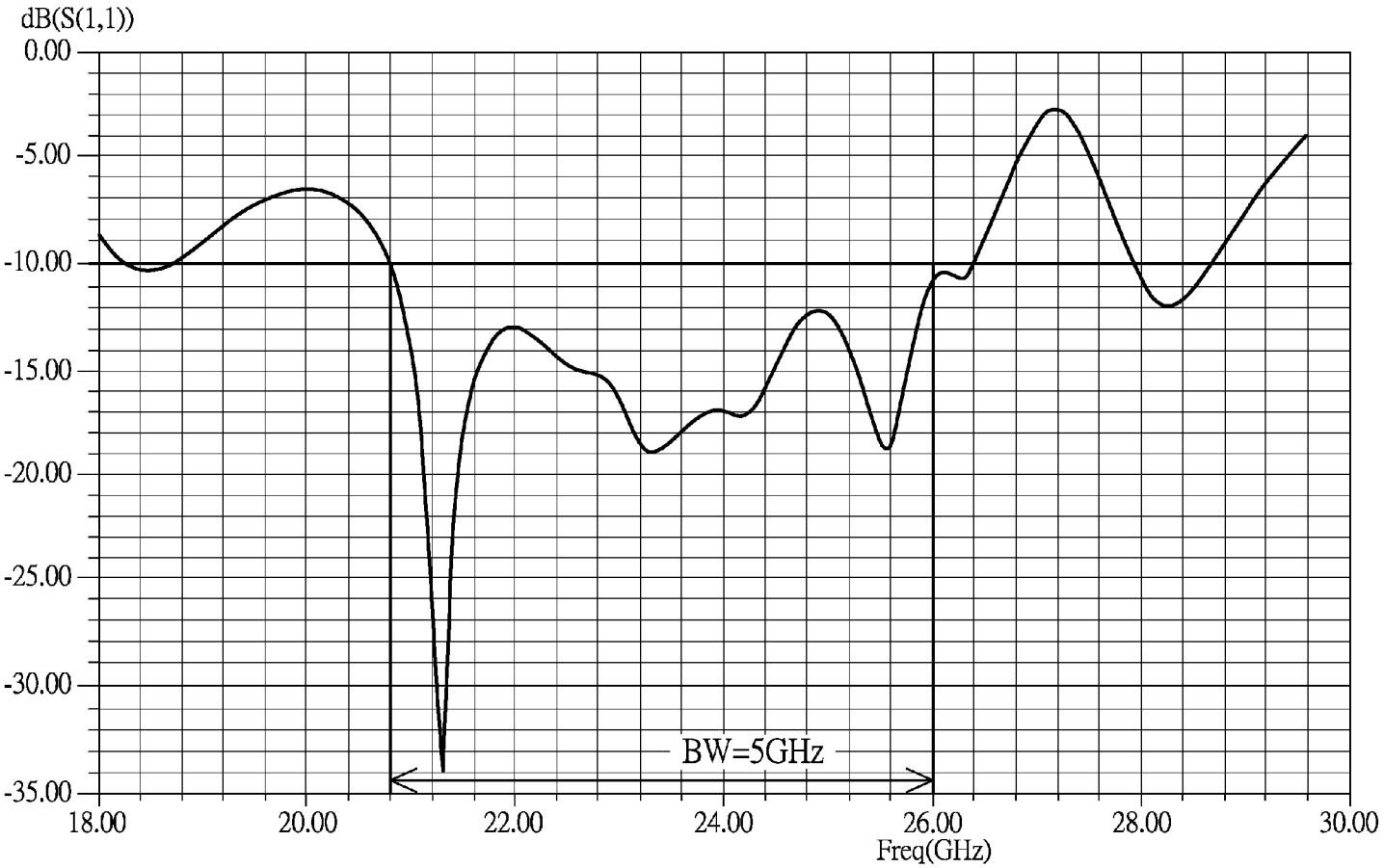
FIG. 5 is a reflection coefficient chart of the horn antenna device of the invention.

With reference to FIG. 5, a reflection coefficient (S11) chart of the electromagnetic waves generated from the horn antenna device of the invention is disclosed. A frequency band to operate the step-shaped signal feed-in apparatus 10 is 24.0 (GHz). The return loss between 24.0 (GHz) and 24.512 (GHz) is far lower than −10 (dB). A band width approximates 5 (GHz), wherein 26.0 (GHz)−21.0 (GHz)=5 (GHz). As a result, the band width of the invention is far wider than the convention band width of 1.75 (GHz).

Figure 6:
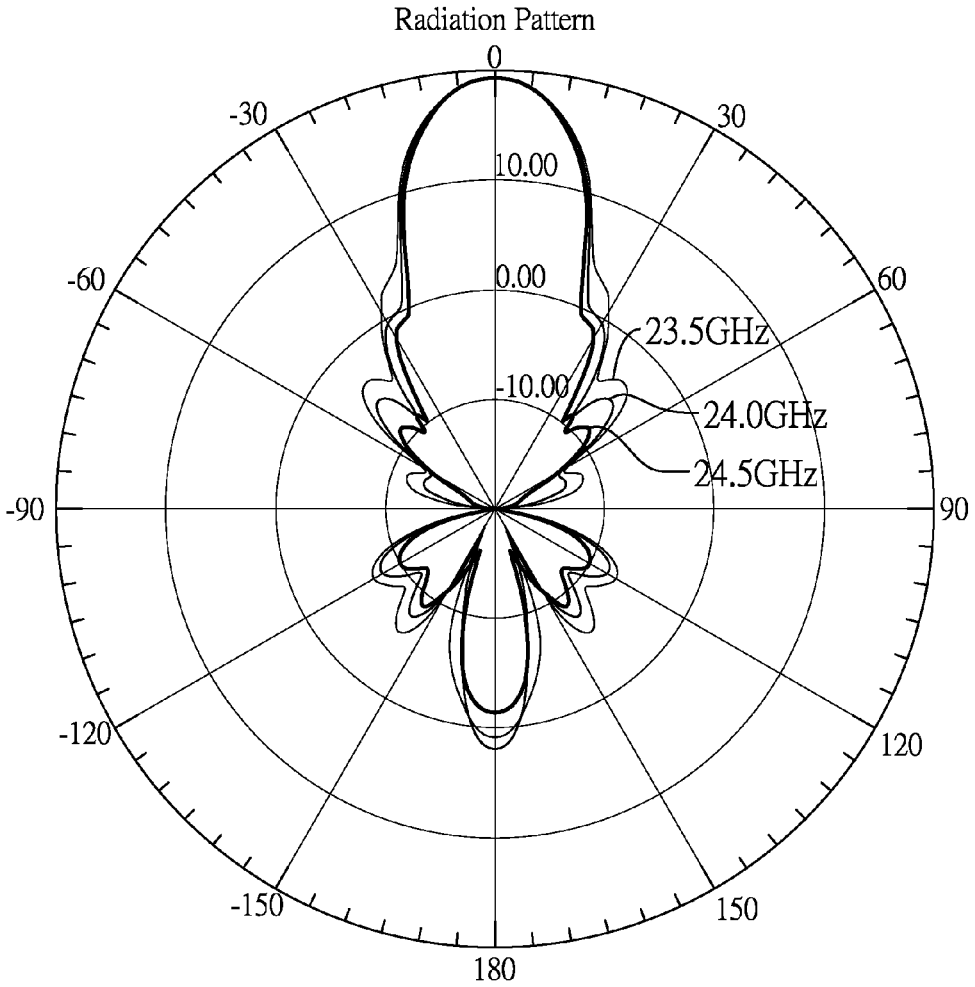
FIG. 6 is a radiation pattern of the horn antenna device of the invention.

With reference to FIG. 6, a radiation pattern of the horn antenna device of the invention is disclosed. The directivity of the horn antenna device at 23.5 (GHz), 24.0 (GHz) and 24.5 (GHz) respectively approximates 19 dBi. The half-power beam width (HPBW) approximates 19 degrees. Thus the size of the horn antenna device of the invention can be minimized by further increasing the directivity.

Figure 7:
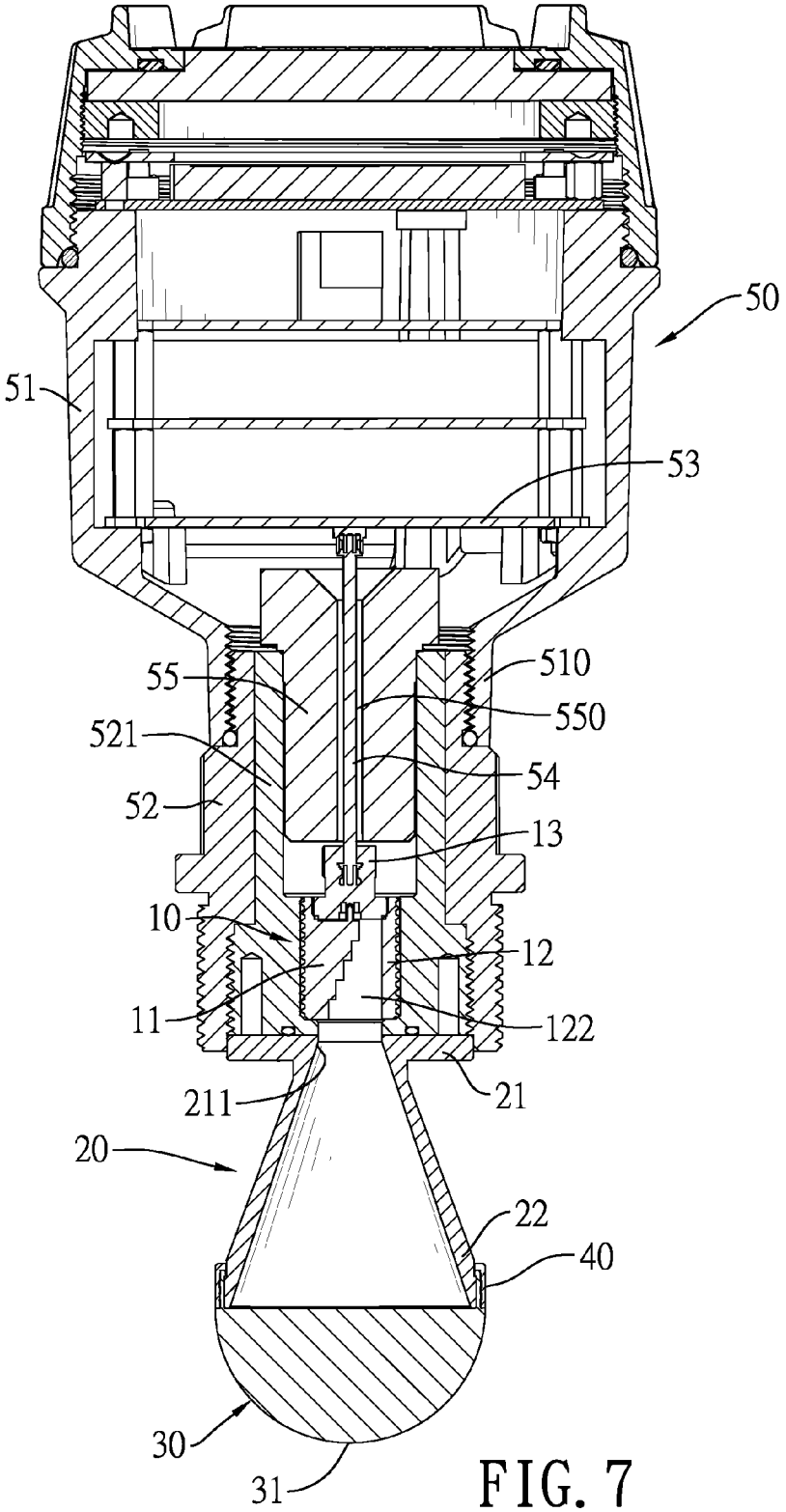
FIG. 7 is a cross-sectional view of a radar level meter equipped with the horn antenna device of the invention.
Figure 8C:
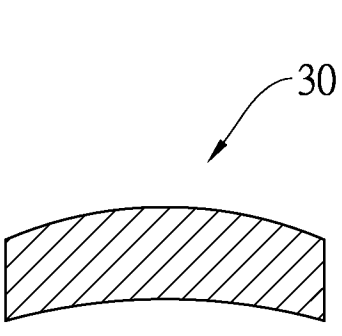
FIGS. 8A-8F are cross-sectional views of embodiments of the lens antenna.
Figure 8B:
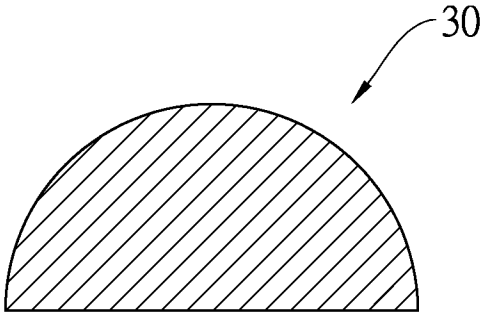
Figure 8A:
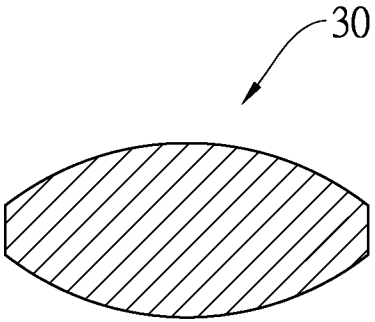
Figure 8F:
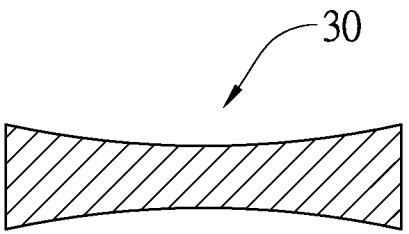
Figure 8E:
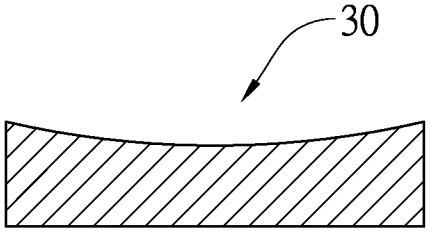
Figure 8D:
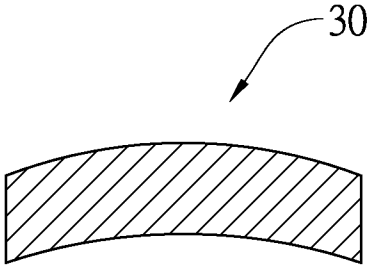
Figure 9:
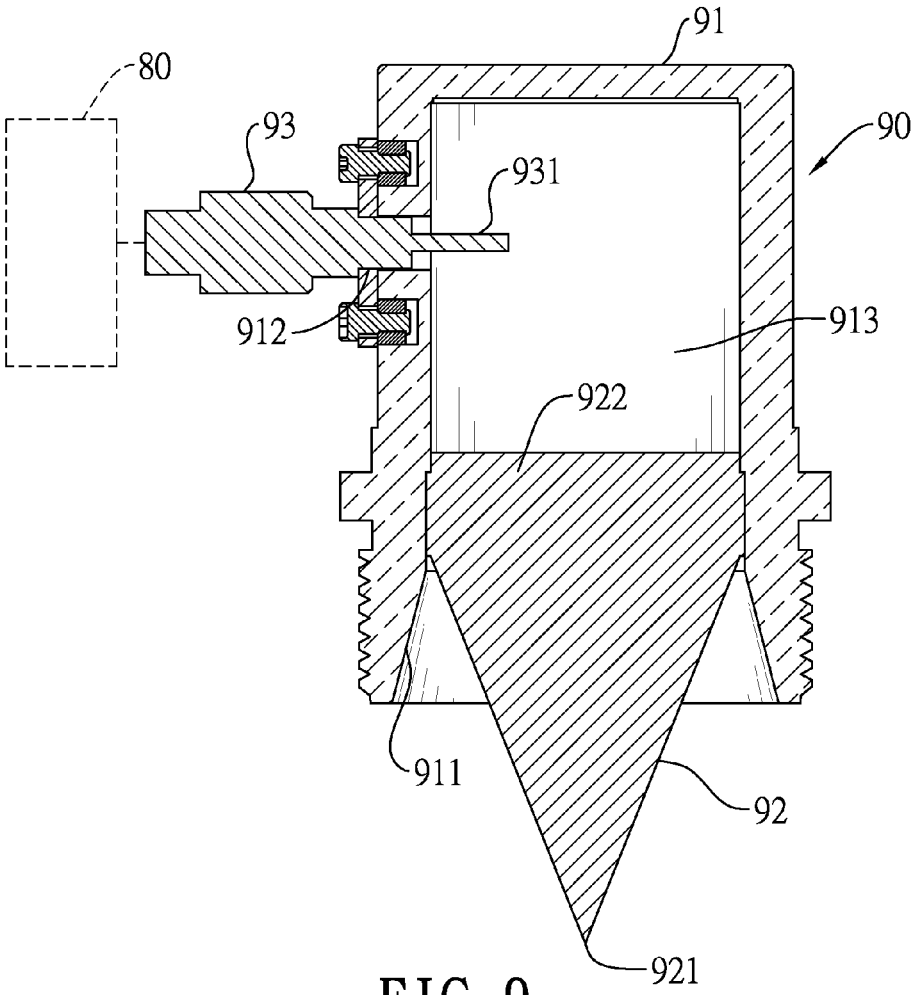
FIG. 9 PRIOR ART
FIG. 9 is a conventional level measuring device.
Figure 10:
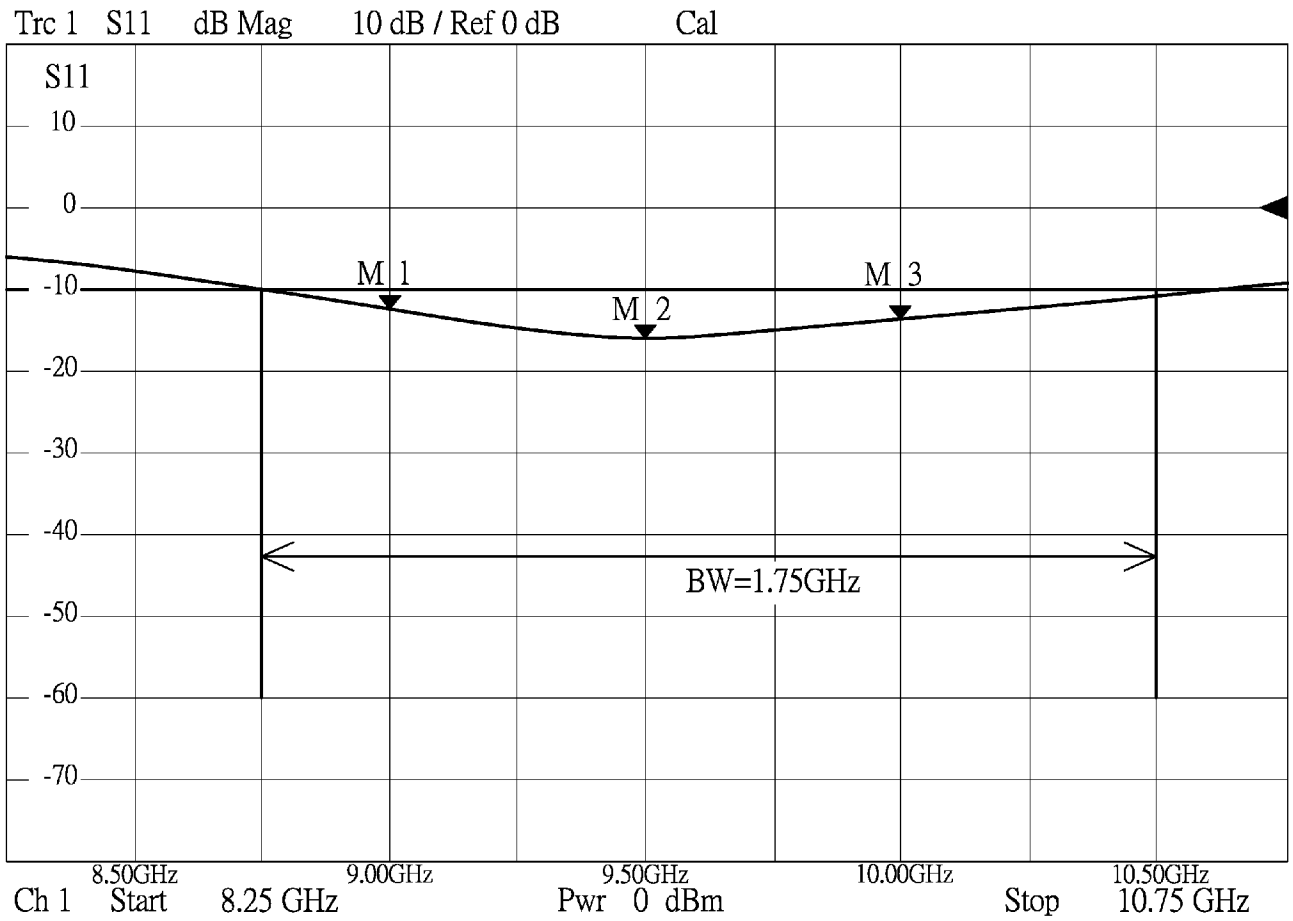
FIG. 10 PRIOR ART
FIG. 10 is a reflection coefficient chart of the conventional level measuring device.

With reference to FIG. 7, a radar level meter 50 is equipped with the step-shaped signal feed-in apparatus 10, the conical horn antenna 20 and the lens antenna 30 of the invention. The radar level meter 50 has a body 51, a first bushing 52 and a second bushing 521. The body 51 is hollow and has a connecting end 510. At least one circuit board 53 is mounted in the body 51. The first bushing 52 is connected to the connecting end 510 of the body 51. The second bushing 521 is mounted in the first bushing 52 and has a mounting end. The step-shaped signal feed-in apparatus 10 of the invention is mounted in the second bushing 521.

The mounting end of the second bushing 521 is adapted to be connected to the panel 24 of the conical horn antenna 20. The mounting end of the second bushing 521 can be screwed into the screw holes 240 of the panel 24 to fix the conical horn antenna 20 to the second bushing 521.

The circuit board 53 is electrically connected to a coaxial adapter 54. The coaxial adapter 54 is electrically connected to the socket 131 of the head 13. A fixture 55 is mounted in the second bushing 521 and between the circuit board 53 and the head 13. The fixture 55 has a central through hole 550, such that the coaxial adapter 54 can pass through the central through hole 550 to be aligned with the head 13. The circuit board 53 sends a high frequency signal to the step-shaped signal feed-in apparatus 10 through the coaxial adapter 54. When the step-shaped signal feed-in apparatus 10 receives the high frequency signal, the step-shaped signal feed-in apparatus 10 radiates electromagnetic waves based on the high frequency signal.

The dielectric coefficient of the lens antenna 30 is different from the dielectric coefficient of the air. A delay lens or a fast lens can further formed on the lens antenna 30. The propagation speed of an electromagnetic wave is delayed resulting from the medium of the delay lens. The delay lens can be a dielectric lens or an H-plan metal plate. The propagation speed of an electromagnetic wave is boosted resulting from the medium of the fast lens. The fast lens can be an E-plan metal plate.

The medium of the dielectric lenses mentioned above includes nonmetallic dielectric, metallic dielectric and artificial dielectric. When a wireless signal is emitted through the dielectric lens, a wave front of the wireless signal becomes a plane wave front. With reference to FIGS. 8A-8F, the lens antenna 30 can be shaped into bi-convex, plano-convex, positive meniscus, negative meniscus, plano-concave or bi-concave.

In conclusion, the radar level meter 50 generates high frequency signals to the stepped body 11, and the stepped body 11 radiates electromagnetic waves according to the high frequency signals through the conical horn antenna 20 and the lens antenna 30. The electromagnetic waves are reflected by an object, such that the stepped body 11 also receives a reflection of the electromagnetic waves. The resonating modes of the horn antenna device of the invention can be easily determined and designed according to dielectric of air and the step-shaped signal feed-in apparatus 10. The directivity performance of the horn antenna device of the invention is improved. The stairs are directly connected to the connecting pin, such that high frequency signals can be accurately sent from the connecting pin to the stairs. The stability of the horn antenna device is improved.

What is claimed is:

1. A step-shaped signal feed-in apparatus comprising:
- a fixture base having:
  - a first end;
  - a second end distal to the first end; and
  - a connector inserted into the first end and formed with a through hole therein, wherein the through hole has a step shaped interior surface;
- a head protruding to form a socket, and the socket being inserted into the through hole of the connector of the fixture base; and
- a stepped body mounted in the fixture base and having:
  - multiple stairs sequentially formed along an axial direction of the fixture base, wherein a highest stair is near the first end of the fixture base, and a lowest stair is near the second end of the fixture base; and
  - a connecting pin integrally formed and protruded from a side surface, facing the connector, of the highest stair along the axial direction of the fixture base and connected to the socket of the head, a gap being provided between a side of the connector facing the stepped body and the side surface, facing the connector, of the highest stair of the stepped body; and
  - the head, the connector, and the stepped body are disposed linearly along the axial direction of the fixture base.

2. The apparatus as claimed in claim 1, wherein a length of each stair is quarter of a wave length of an electromagnetic wave emitted from the stepped body.

3. The apparatus as claimed in claim 1, wherein height differences between each two adjacent stairs are equal to each other.

4. The apparatus as claimed in claim 1, wherein an extending direction of the connecting pin is parallel to the axial direction of the fixture base.

5. The apparatus as claimed in claim 2, wherein an extending direction of the connecting pin is parallel to the axial direction of the fixture base.

6. The apparatus as claimed in claim 3, wherein an extending direction of the connecting pin is parallel to the axial direction of the fixture base.

7. A horn antenna device comprising:
- a step-shaped signal feed-in apparatus comprising:
  - a fixture base having:
    - a first end;
    - a second end distal to the first end; and
    - a connector inserted into the first end and formed with a through hole therein, wherein the through hole has a step shaped interior surface;
  - a head protruding to form a socket, and the socket being inserted into the through hole of the connector of the fixture base; and
  - a stepped body mounted in the fixture base and having:
    - multiple stairs sequentially formed along an axial direction of the fixture body, wherein a highest stair is near the first end of the fixture base, and a lowest stair is near the second end of the fixture base; and
    - a connecting pin integrally formed and protruded from a side surface, facing the connector, of the highest stair along the axial direction of the fixture base and connected to the socket of the head, a gap being provided between a side of the connector facing the stepped body and the side surface, facing the connector, of the highest stair of the stepped body; and
  - a conical horn antenna having:
  - a signal input-and-output (I/O) end connected to the second end of the fixture base of the step-shaped signal feed-in apparatus; and
  - a signal radiating end distal to the signal I/O end; and the head, the connector, and the stepped body are disposed linearly along the axial direction of the fixture base.

8. The device as claimed in claim 7 further comprising a lens antenna mounted on the signal radiating end of the conical horn antenna.

9. The device as claimed in claim 8, wherein the fixture base of the step-shaped signal feed-in apparatus has a space; and the conical horn antenna has:

a panel laterally extending on the signal I/O end; and an opening formed in a middle of the panel and communicating with the space of the fixture base.

10. The device as claimed in claim 9, wherein the panel has multiple screw holes.

11. The device as claimed in claim 10, wherein the signal radiating end of the conical horn antenna has an engaging protrusion; the lens antenna comprises a hook for being engaged with the engaging protrusion of the signal radiating end of the conical horn antenna.

12. The device as claimed in claim 10, wherein the lens antenna comprises a lens body having a plane surface; and the hook is formed on an edge of the plane surface of the lens body.

13. The device as claimed in claim 12, wherein the lens body is a hemispherical body.

14. The device as claimed in claim 13, wherein the hook of the lens body has external threads; and a ring has internal threads to be screwed with the external threads of the hook.

15. The device as claimed in claim 14, wherein the lens antenna is made of materials selected from a group consisting of metal, PVDF, polytetrafluoroethene, paraffin, polyethylene, polymethylmethacrylate, polystyrene, flint glass, polygas and Rutile.

16. The device as claimed in claim 14, wherein the lens body of the lens antenna is selected from a group consisting of a convex lens, a concave lens, a Bi-convex lens, a Plano-Convex lens; a Positive meniscus lens, a Negative meniscus lens, and a Plano-concave and Bi-concave lens.

* * * * *